US005368369A

United States Patent [19]

Maity et al.

[11] Patent Number: 5,368,369

[45] Date of Patent: Nov. 29, 1994

[54] EQUIPMENT USEFUL FOR WINNING ORES PARTICULARLY COAL IN LONGWALL MINING

[75] Inventors: Sibnath Maity; Bharat B. Dhar, both of Dhanbad Bihar, India

[73] Assignee: Council Of Scientific & Industrial Research, New Delhi, India

[21] Appl. No.: 68,689

[22] Filed: May 27, 1993

[51] Int. Cl.[5] ..... E21C 35/20; E21D 23/00

[52] U.S. Cl. ..... 299/11; 299/18; 299/43

[58] Field of Search ..... 299/11, 18, 19, 43

[56] References Cited

U.S. PATENT DOCUMENTS 3,834,762 9/1974 Kakajima ..... 299/43

FOREIGN PATENT DOCUMENTS 1550727 8/1979 Great Britain .
3031113 4/1982 Germany .
3428854 1/1986 Germany .
3624731 4/1988 Germany .

OTHER PUBLICATIONS

G. Von Klinggraff "Schreitenausbau für den . . ." Vol. 117, No. 8, April 23, 1981, *D. Bochum*, pp. 422–427.

*Primary Examiner*—David J. Bagnell
*Attorney, Agent, or Firm*—Ladas & Parry

3 Claims, 4 Drawing Sheets

[57] ABSTRACT

The present invention relates to an improved equipment useful for winning of ores particularly coal in longwal mining, the equipment comprises hydraulic master chock shield having atleast two legs at the outer edges, the master chock shield having a cylindrical conveyor belt intake end roller rotatibly mounted on a stand fixed to the base plate of the master chock shield, the base plate of the said chock shield also being provided with a plurality of stands having free moving conveyor belt guide rollers a plurality of known hydraulic chocks having atleast four legs at its edges, being placed in front of master chock shield in a horizontal line, the master chock shield and the chocks being interlinked by atleast one hydraulic ram, the base plates of each of the chocks being provided with plurality of stands having free conveyor belt guide rollers, the end chock also being provided with two horizontally fixed multi-telescopic booms supported on free moving wheels the extreme end of the booms being fixed to a fixed belt conveyor structure the fixed belt conveyor structure having free moving conveyor belt guide rollers a drive head conveyor belt roller being provided at the extreme end of the fixed structure.

EQUIPMENT USEFUL FOR WINNING ORES PARTICULARLY COAL IN LONGWALL MINING

BACKGROUND OF THE INVENTION

1. Field of the Invention

This invention relates to an improved equipment useful for winning of ores, particularly coal in longwall mining.

2. Description of the Prior Art

Longwall mining is the most efficient and globally practised underground method of winning coal, which offers possibility of complete automation. Gradually, over the years there has been consistent effort to reduce the manpower deployed at a longwall face. In fact, any device can be made fully automatic only when the whole operation involved is machine dependent using practically no manpower. With the present longwall mechanisation system available, only the face machine system can be made automatic as the face operations are fully mechanised, but at the same time it involves many other functions in gateroads, most of which are manually operated, and therefore, become hindrance to the further automation of the system.

Here the existing equipment for longwall mining is illustrated with reference to FIG. 1 of the drawings accompanying this specification. There are two sets of master chock shield (1) and slave chock shield (2) at the two rear ends of longwall face equipment with general chock shields within them along the face. In front of the chock shields there is an armoured face conveyor (3) along the face which has got two sigma sections on both sides of it over which a shearer (4) is movably installed. Shearer cuts coal and loads automatically to the armoured face conveyor (hereinafter called AFC) (5). At the discharge end of AFC (5) there is another armoured conveyor at the right angle along gate road, which is called Bridge Stage Loader (hereinafter called BSL) (6). One BSL (6) is elevated like a bridge. At the discharge end of BSL there is a belt conveyor along gate road in the same line which is called gate belt conveyor (GBC) (7) which discharges to trunk belt conveyor (not shown). There are unit vertical supports (not shown) upto 30 meters ahead of working face. There is a rail line (9) along the gate road beside the gate belt conveyor.

Longwall method involves the following operations as practised commonly—(a) cutting of coal by shearer or by plough (b) conveying coal from face by AFC, (c) crushing of coal to size, (d) conveying coal from armored face conveyor to trunk belt conveyor by bridge stage loader and from there to out-bye system (e) supporting the face, (f) supporting gateroads, (g) shifting of bridge stage loader and power pack (h) dismantling of rails, (i) tensioning arrangement and shifting of belt intake (low height) structure and (j) belt shortening at intervals. Out of the above functions, some are totally and some are partially dependent on manual operations.

Most important of them is the supporting of gateroads. The bolted roof of the gateroads are supported by unit vertical supports (mainly by hydraulic props) by rows either individually or along with girders (24) as goal post support, generally upto a distance of 30 m in front of the face, as a norm being directed by Director General of Mines Safety (India). The operations of installation of props with proper setting load and withdrawal of the same are mostly manual functions. A crusher (10) is mounted over the BSL for sizing coal suitable for belt conveyor. This BSL requires supervision at both the ends and also at the crushing point. The vital point is that it has to be advanced for every cut of coal face which is mostly a manual operation with the help of a double acting ram and hydraulic props tightly set along the gateroads.

The power pack (11) for hydraulic power supply and Gate End Boxes (12) for electrical power supply are generally mounted over rails so it is necessary to maintain the rail line laid over wooden sleepers upto a few meters ahead of the face along the main gateroad (25). Shifting of power packs is a cumbersome process which involves additional unskilled manpower for the operation. Thus, it is clear that there are many operations in a longwall method which are still dependent on manual labour.

SUMMARY OF THE INVENTION

The object of the present invention is to provide an improved equipment useful for winning of coal in longwall mining which obviates the drawbacks of the presently known equipment.

BRIEF DESCRIPTION OF THE DRAWINGS

As noted above.

DESCRIPTION OF THE PREFERRED EMBODIMENTS

Figure 1:
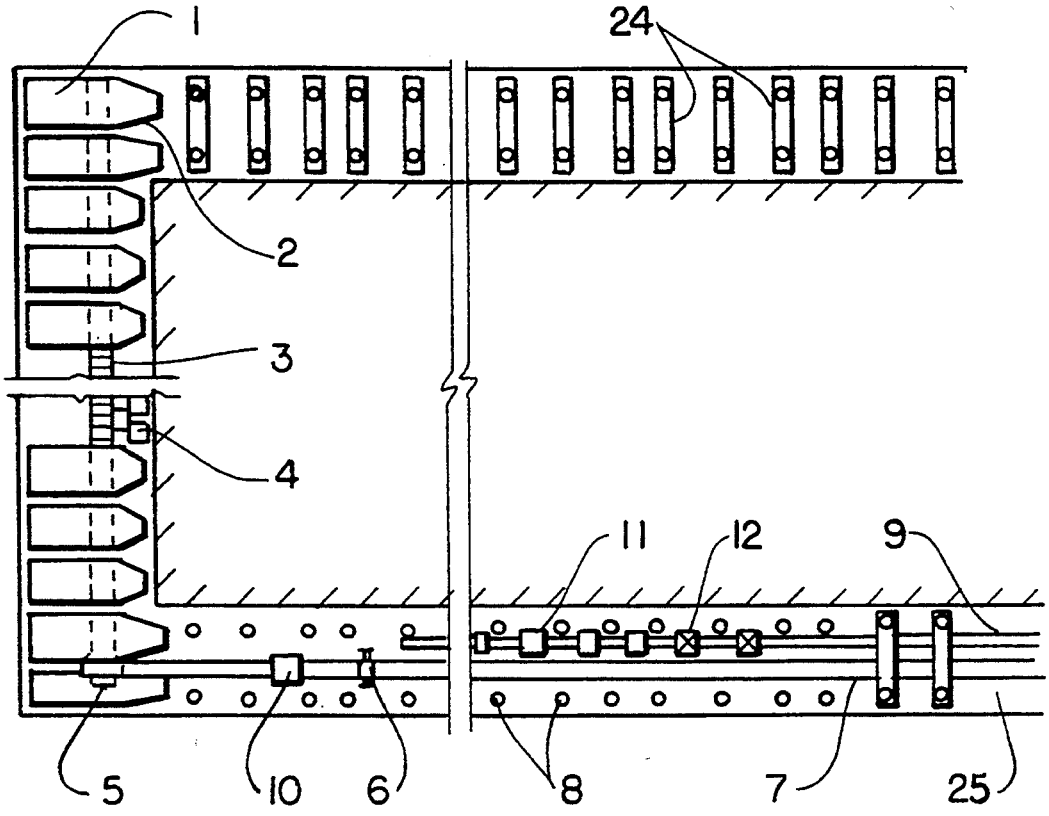
FIG.1 PRIOR ART
FIG. 1 depicts a prior art longwall mining system.

Accordingly the present invention provides an improved equipment useful for winning of ores, particularly coal in longwall mining which comprises a known hydraulic master chockshield (1) (please refer FIG. 2) having at least two legs at the outer edges, the master chock shield having a cylindrical conveyor belt intake end roller (13) rotatably mounted on a stand (14) fixed to the base plate (15) of the master chock shield, the base plate of the said chock shield also being provided on its upper side with a plurality of stands (16) having free moving conveyor belt guide rollers (17), a plurality of known hydraulic chocks (18) having at least four legs at its corner edges being placed in front of master chock shield in a horizontal line, the said master chock shield and the chocks being interlinked by means of at least one hydraulic ram (19), the base plates of each of the chocks being provided with plurality of stands having free conveyor belt guide rollers, the end chock (20) also being provided with two horizontally fixed multi-telescopic booms (21) supported on free moving wheels (22), the extreme end of the said booms being fixed to a fixed belt conveyor structure (23), the fixed belt conveyor structure having free moving conveyor belt guide rollers, a drive head conveyor belt roller being provided at the extreme end of the fixed structure.

In an embodiment of the present invention the multi-telescopic boom is of hydraulic or mechanical type.

The present invention will incorporate an improvement in the longwall system of mining which would free the system significantly from manual components, thereby increasing its efficiency and also safety.

Figure 2:
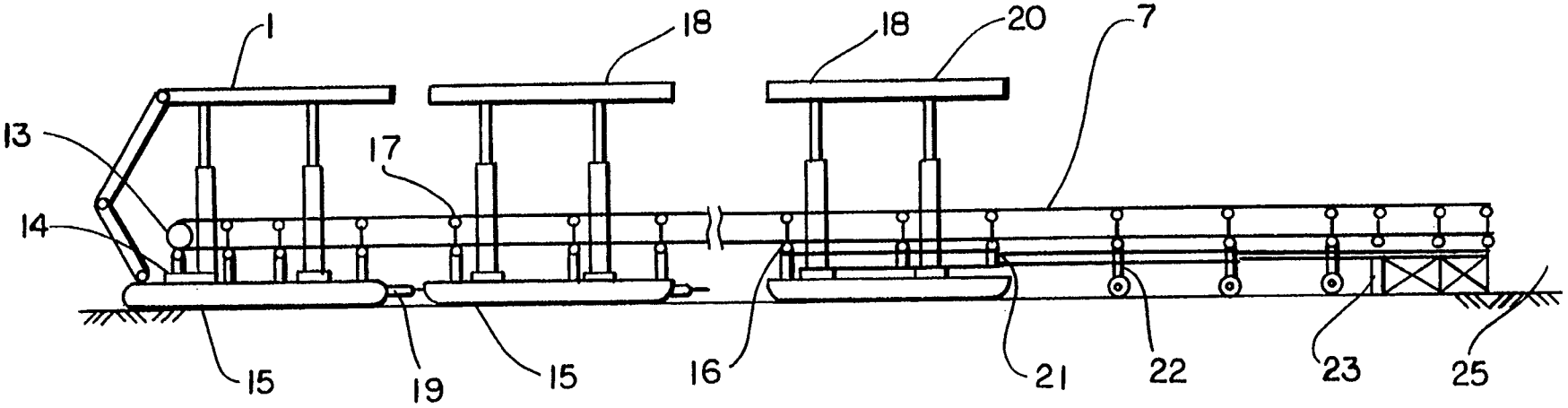
FIG. 2 shows the schematic diagram of the master chock-shield, chocks in the gallery and the telescopic roller arrangement for the belt conveyor of the present invention.
Figure 3:
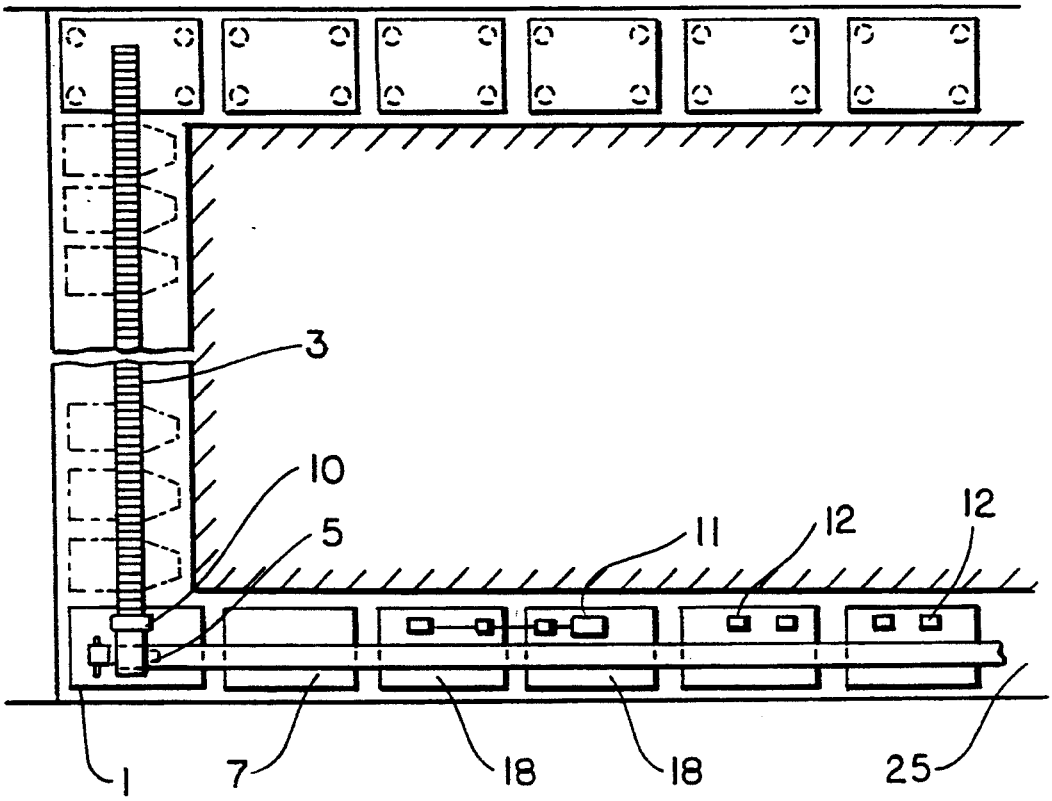
FIG. 3 depicts the layout of longwall face equipment with the improved arrangement of new equipment of the present invention in the gateroad.
Figure 4:
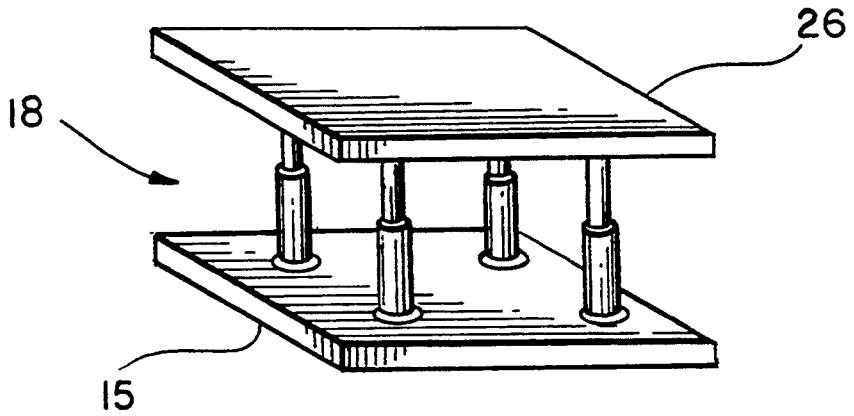
FIG. 4 depicts the schematic diagram of a "gallery chock" i.e. a rectangular 4-legged chock which will be installed in front of the master chockshield in the gallery.
Figure 5:
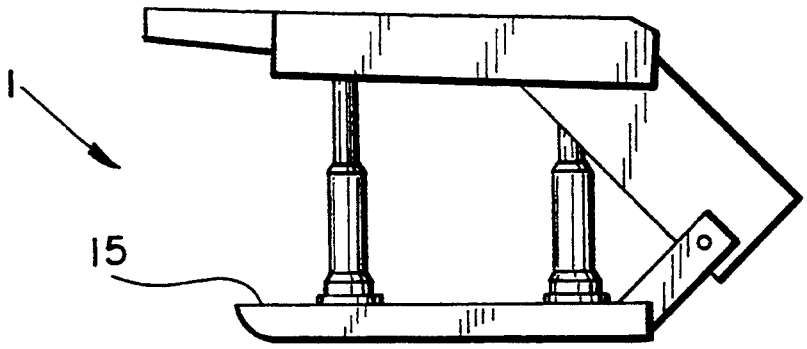
FIG. 5 depicts the side view of general layout of a 4-legged master chock shield being used at the end of the longwall face.

The present invention, instead of unit vertical supports (8) in the gateroads provides four legged chocks (18) in the gateroads (FIGS. 2, 3 & 4) upto a distance of 30 meters from the face that has been marked as the zone of the direct influence of front abutment of a longwall caving face. The length of canopy (26) of each chock may be of approximately 6 m with width of 4 m such that five chocks will be enough to cover a distance of 30 m along gallery (FIG. 3). Instead of general master and slave shield support, there may be placed a single bigger size master chock shield to accommodate the gallery end with other chocks in a row (FIGS. 2 & 4).

By this system bridge stage loader (6) is to be eliminated in between the AFC and belt conveyor in the main gateroad. The crusher/lump-breaker (10) may be mounted over the AFC drive head (5) within the support of master chock shield (FIG. 3). The intake end of belt conveyor (7) will be placed over the base frame of chocks which will directly receive coal from AFC which has to be a side discharging type. The guide rollers (17) will be installed on the base frame (15) for belt conveyor. There will be a proposed gap of around 8 to 9 meters in between the last chock in the gallery and the first belt structure which will be accommodated by a telescopic boom (21) being attached with the last gallery chock. That mechanical and/or hydraulic multi-telescopic boom (21) along with movable roller arrangement with the help of bottom wheels (22) will extend upto the fixed structure end (23) of belt conveyor gradually with the advancement of face, along the proposed gap. These movable rollers will hold the conveyor belt along the gap. This will help not to disturb belt conveyor structure for every cut of shearer as such what was accommodated by the bridge stage loader (6) of earlier system.

The main hindrance for mining a longwall face is the erection of vertical props in the gateroads. By implementation of self advancing powered support in the gateroads the problem of erection and withdrawal of props is eliminated. In roadway of properly bolted roof, the face will advance smoothly with the integrated chocks in the gateroads in a form of second bracket ("[") altogether. The bridge stage loader need not be attended to for its movement and maintenance, as it will not be there at all in the system. The purpose of overlapping upon the belt conveyor by the BSL discharge end (for not to disturb belt structure for a few meters) has been accommodated by a special multi-telescopic mechanism in between the end of gallery chock and the first belt not be specially supported (as it was vertical prop or by any other arrangement as the intake end roller will be fixed upon the base frame of master chock shield and it will be under the drive head of AFC which will discharge coal at right angle to the belt through a small chute.

The power pack and the Gate End boxes would be placed over the base frame of gallery chocks which will move automatically with the movement of face with the gallery chocks (FIG. 3). Therefore there is no necessity for man power for attending movement of power pack upon the rail and moreover for dismantling of rails for every advancement of face. The rails could be withdrawn at a time at the beginning of face advancement. This will improve the running speed of a longwall face.

The gallery chocks may be controlled from adjacent chock or remotely from the master chock shield. Therefore, the automatic control of whole support system gets easier. Thus by the application of new system, 80% of manpower may be reduced from the present requirement in a longwall gateroad and complete automation may be possible with this type of method of extraction.

The gateroads are supposed to be stressed highly in a longwall method and rather predominantly upto a zone 30 m ahead of the face due to front abutment pressure which reaches its peak at the time of first main fall or subsequent main falls. Under incompetent roof there may be occasions of high convergence and possible roof collapse. It is obvious that in an adverse gateroad condition it is difficult to run a longwall face safely and efficiently. In the proposed system with the use of self advancing four legged chocks in the gateroads the immediate 30 m from the face can be safely supported with the important equipments under the guard of canopy placed skin to skin with the neighbour chocks. Moreover the sufficient setting load can be provided to the immediate roof of gateroads and also desired yielding could be provided by the chocks to accommodate extensive increase of stress in the roof. Thus a longwall panel may be moved safely and efficiently even under the adverse conditions of incompetent roofing gateroads. The first chock (the just front one of the master chock shield) may be of higher load capacity at per with the face support as it indicates steep rise of stresses at the very proximity of the face and then it diminishes with the distance. The next chocks may be of lower load bearing capacity. The likely roof deterioration in the gateroad and occasional roof fall hinder the efficiency of the entire longwall operation in a great way. With the implementation of the modified system the self advancing chock would be used in the gateroad and would improve the resultant roof condition thereby eliminating the possibility of roof fall in the gateroad.

The practising engineers in a running longwall panel usually face the problem of creeping with the package of longwall face equipment. As the longwall face is generally placed along the dip rise direction and if the dip is considerable the whole package slides down which generally is mentioned as creeping phenomenon. To avoid this slippage of AFC the drive head end of AFC is generally kept in advance than the tail gate end. But if the lag between main gate and the tail gate end increases it poses the problem of creeping i.e. the face package with AFC slides upward, creating the problem of alignment of AFC drive head and belt conveyor intake end. This awkward problem of creeping would be solved by the implementation of the improved system.

The whole face equipment is linked as a loop together with the gateroad chocks which will prevent the AFC to slide down as the six chocks including master shield will be fixed tightly while the face will be advanced by the snaking operation. The anchorage for master chock shield may be estimated such that it can prevent slippage of the face package when it is advanced by the snaking of shields one by one or by a batch. The downward force responsible for slippage $$= \sum_{i=1}^{n} W_i \operatorname{Sin} O - M_k W_i \operatorname{Cos} O$$

where w=weight of the face support (shield), O=dip of the $M_k$=kinetic co-efficient of friction between the floor of the seam and the base plate of the shield and n=varies from 2 to 10 depending on the number of shields operated in a batch.

This downward force responsible for creeping would be taken care by the gallery chocks even in a straight dip rise longwall face.

The improved system eliminates bridge stage loader and the maintenance of rail in the gateroad. As the time consumption for advancement of BSL and also for its maintenance and break down will be nil, the efficiency will no doubt be improved. It generally requires considerable time and manpower for installation and withdrawal of vertical supports in the gateroads of a longwall panel and also for dismantling of rails.

Initially for use of chocks at the gateroads the suggested package may cost higher than the present package but at the same time the cost of BSL and cost of individual vertical supports will be substructed from the package. Further, the running cost of BSL with its power consumption, maintenance and breakdown and also capital for the vertical supports will be nil in the new system. The productivity will be increased significantly as the running time and efficiency of the whole package could be improved considerably in many respects.

With the implementation of new system the manpower requirement will be significantly reduced and the additional capital involved would be small and therefore the overall economy of the suggested system will be better.

The main ADVANTAGES of the equipment of the present invention are (1) automation and speed of longwall extraction process (2) improved strata control and safety (3) prevention of creeping even in a dipping longwall face (4) productivity and economy.

We claim:

1. A system useful for winning of ones which comprises a hydraulic master chock shield having a base plate and having at least two legs that support a canopy, the master chock shield having a cylindrical conveyor belt intake end roller rotatably mounted on a stand fixed to the base plate of the master chock, the base plate of said chock shield also being provided with a plurality of stands having free moving conveyor belt guide rollers, a plurality of hydraulic chocks, each having a base plate and a canopy and having at least four legs at the edges of the base plate to support the canopy, said chock being placed in front of the master chock shield in a horizontal line along a gate road, said master chock shield and the chocks being interlinked by means of at least one hydraulic ram, the base plates of each of the chocks being provided with plurality of stands having free conveyor belt guide rollers, the end chock also being provided with two horizontally fixed multi-telescopic booms supported on free moving wheels, the extreme end of the said booms being fixed to a fixed belt conveyor structure, the fixed belt conveyor structure having free moving conveyor belt guide rollers, a drive head conveyor belt roller being provided at the extreme end of the fixed structure.

2. An improved system as claimed in claim 1 wherein the multi-telescopic boom is of hydraulic or mechanical type.

3. A system according to claim 1 when employed in longwall mining of coal.

* * * * *